US007669745B2

(12) United States Patent
Chang

(10) Patent No.: US 7,669,745 B2
(45) Date of Patent: Mar. 2, 2010

(54) DUAL PROTECTIVE DEVICE OF A HEAVY-DUTY STAPLER

(76) Inventor: Chun-Yuan Chang, P.O. Box 44-2049, Taipei (TW) 10668

( * ) Notice: Subject to any disclaimer, the term of this patent is extended or adjusted under 35 U.S.C. 154(b) by 58 days.

(21) Appl. No.: 12/010,116

(22) Filed: Jan. 22, 2008

(65) Prior Publication Data

US 2009/0184151 A1 Jul. 23, 2009

(51) Int. Cl.
*B25C 5/00* (2006.01)

(52) U.S. Cl. ..... 227/132; 227/156; 227/8; 227/107; 227/108; 227/134; 227/19

(58) Field of Classification Search ..... 227/156, 227/8, 19, 107, 108, 132, 134
See application file for complete search history.

(56) References Cited

U.S. PATENT DOCUMENTS 5,328,075 A * 7/1994 Marks ..... 227/132
5,356,063 A * 10/1994 Perez ..... 227/132
5,492,261 A * 2/1996 Chi ..... 227/128
6,209,772 B1 * 4/2001 Wang ..... 227/134
6,918,525 B2 * 7/2005 Marks ..... 227/120
7,097,084 B2 * 8/2006 Ho ..... 227/8
7,124,922 B2 * 10/2006 Marks ..... 227/8
7,178,709 B2 * 2/2007 Marks ..... 227/107
7,234,621 B2 * 6/2007 Marks ..... 227/8
7,252,217 B1 * 8/2007 Lin ..... 227/8
7,290,692 B2 * 11/2007 Marks ..... 227/8
7,395,955 B2 * 7/2008 Zins et al. ..... 227/132
7,455,206 B2 * 11/2008 Huang ..... 227/120
7,464,843 B2 * 12/2008 Huang ..... 227/8
7,464,844 B2 * 12/2008 Kamins et al. ..... 227/132
7,540,400 B2 * 6/2009 Zins et al. ..... 227/8

* cited by examiner

*Primary Examiner*—Brian D Nash
(74) *Attorney, Agent, or Firm*—Banger Shia

(57) ABSTRACT

The present invention provides a dual protective device of a heavy-duty stapler, in particular to a control device of stapler that controls safely the action of striking slice with spring; of which, a base-controlled active protective device is mounted at rear side of the main body of the stapler, and operated in combination with a manually-operated safety switch that's arranged at front side of the main body of the stapler, thus forming an easy-to-use dual protective device.

4 Claims, 11 Drawing Sheets

DUAL PROTECTIVE DEVICE OF A HEAVY-DUTY STAPLER

BACKGROUND OF INVENTION (1) Field of the Invention

The present invention relates generally to a dual protective device of heavy-duty stapler, and more particularly to an innovative one which is designed with an improved protective device manufactured from stapler striking principle.

(2) Description of the Prior Art

With a powerful spring and striking slice, the stapler can be applied to staplers for heavy-duty stapling purpose.

Unlike a traditional stapler, this stapler has a powerful striking force, which needs to raise great concern of its operational safety. When the stapling base is opened, and the upper cover and stapler body are manually pressed, the staples will be ejected quickly under a strong force, possibly leading to unexpected safety hazards.

SUMMARY OF THE INVENTION

In view of the existing shortcomings of the heavy-duty stapler, the inventor aims to provide a base-controlled active protective device, which, once the base is opened, could prevent the pressing of upper cover and subsequent striking action, thus eliminating the possibility of safety hazards arising from improper operation.

Another purpose of the present invention is to configure a push-type safety switch at front of the main body. With this switch, the trigger in the main body could be disengaged from the coupled striking slice, so the second protective device is formed since no successive stapling operation is generated.

DETAILED DESCRIPTION OF THE PREFERRED EMBODIMENTS

Figure 1:
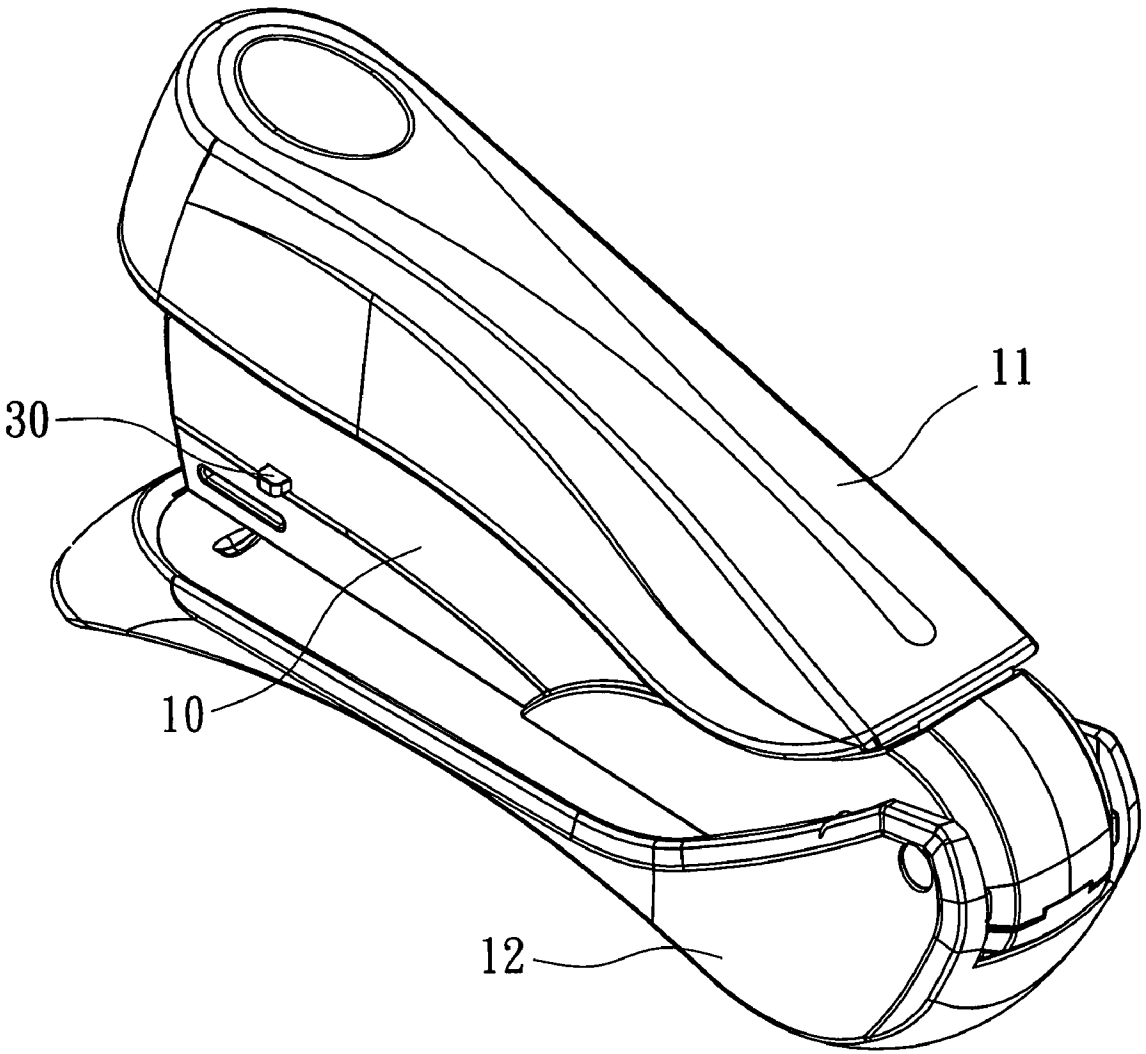
FIG. 1 shows an outside view of the present invention.
Figure 2:
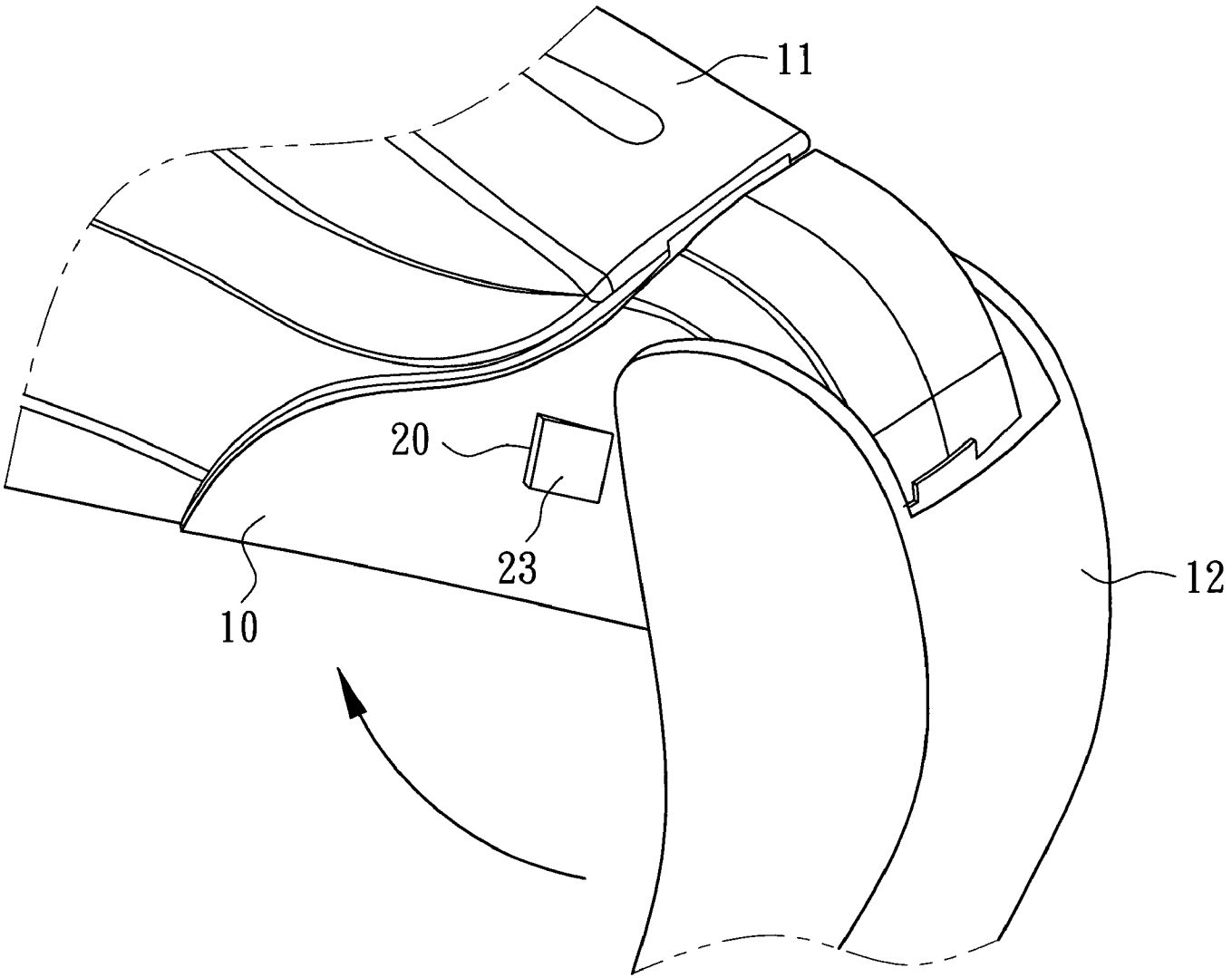
FIG. 2 shows a partially rear view of the present invention.
Figure 3:
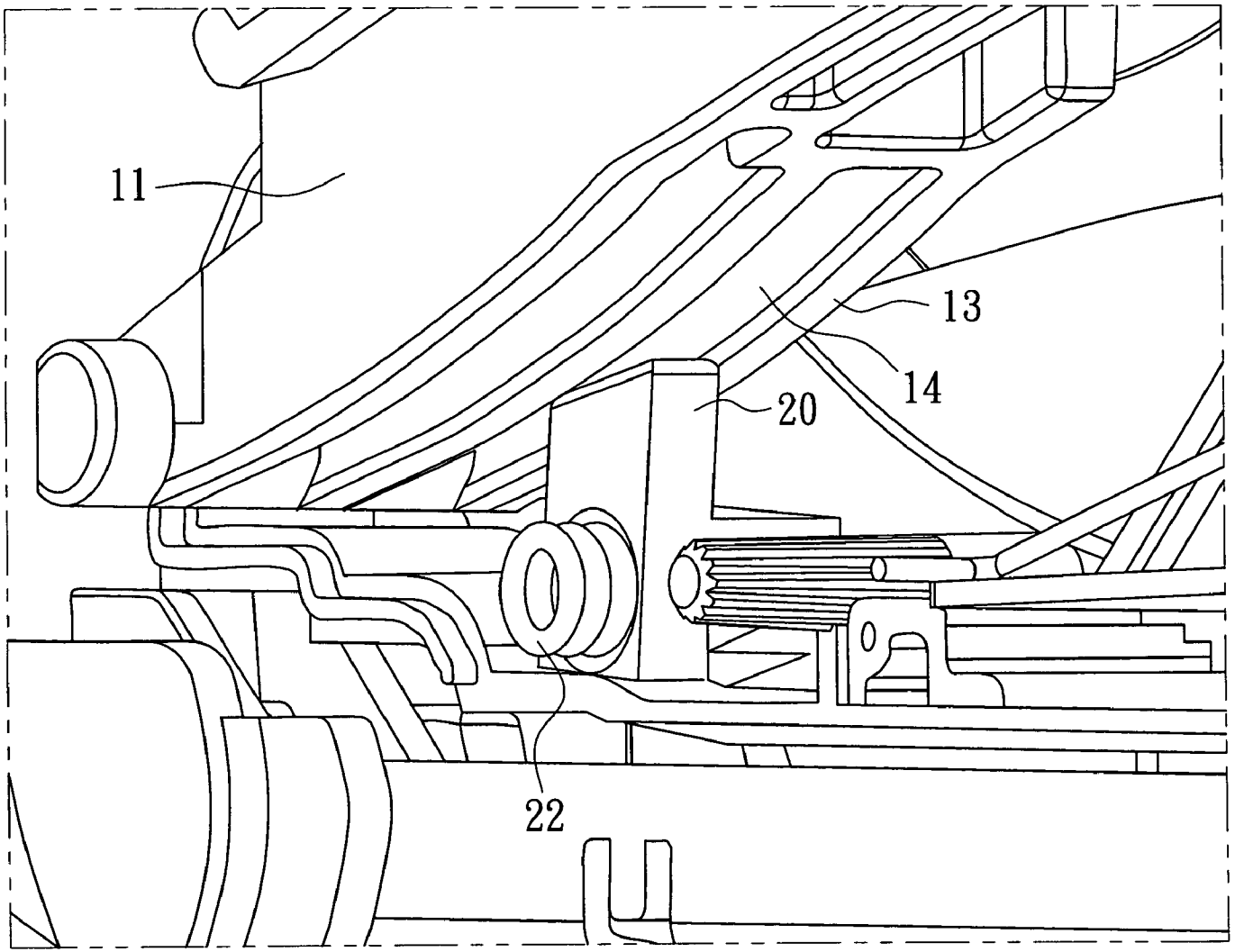
FIG. 3 shows a partially rear view of internal components of the present invention.
Figure 4:
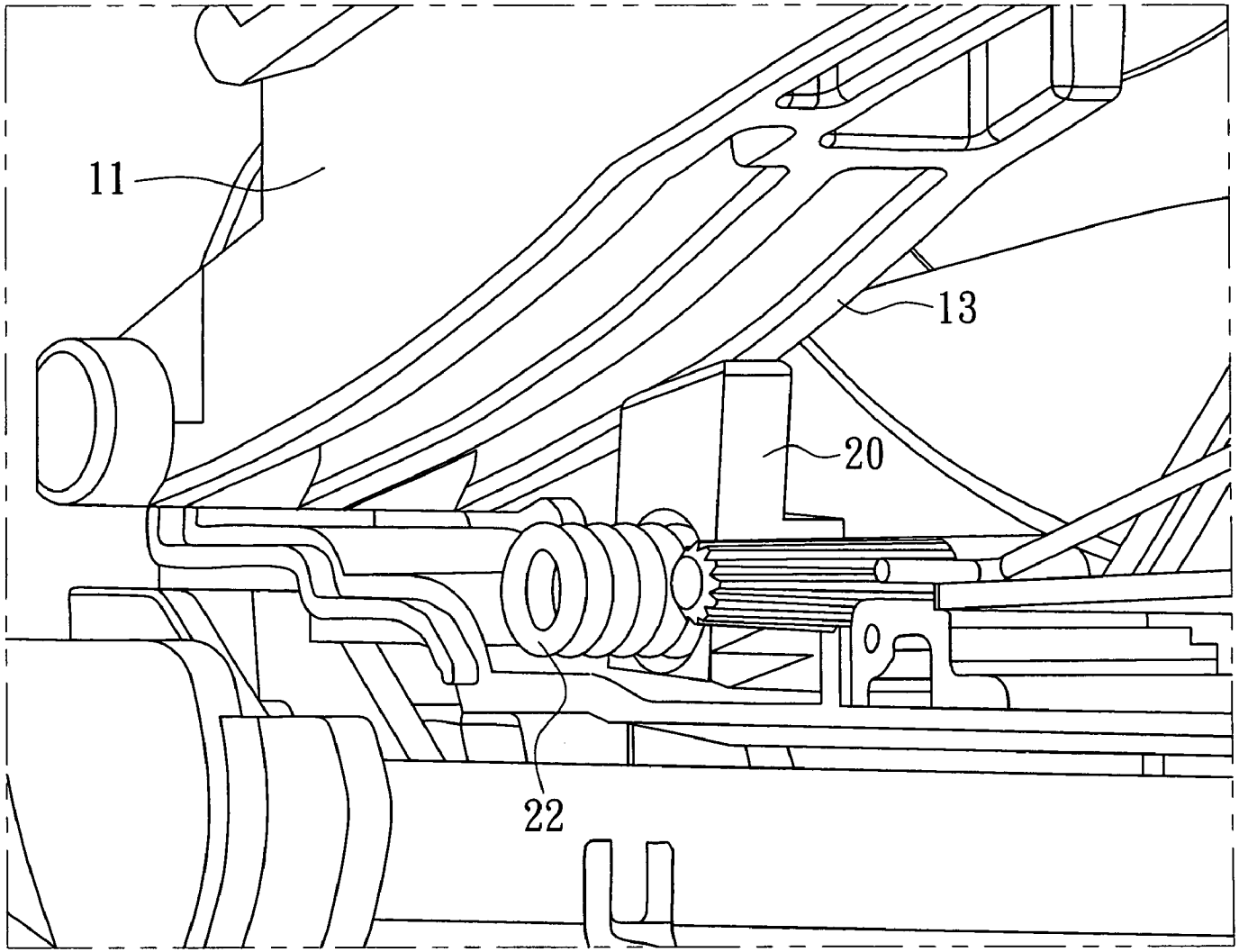
FIG. 4 shows another partially rear view of internal components of the present invention.
Figure 5:
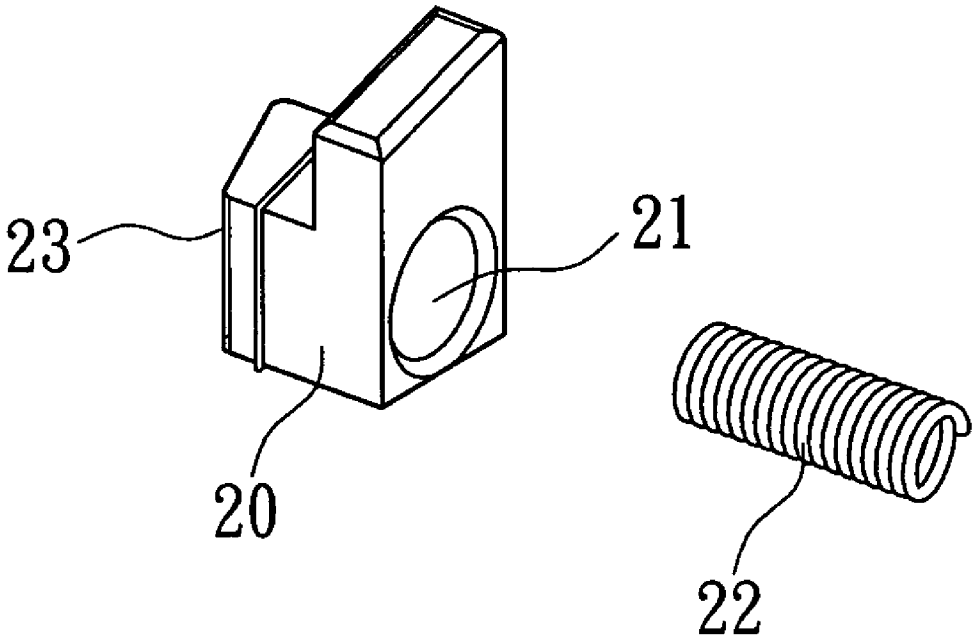
FIG. 5 shows a perspective view of locating block of the present invention.

Based on the preferred embodiments, the structural composition and technical efficacy of the present invention are described below:

FIGS. 1, 2, 3, 4, 5 depict an active protective device of the present invention. Referring to FIG. 5, this protective device comprising: a L-shaped locating block 20 with a sleeving hole 21, used to accommodate a spring 22 at one side of the main body 10; an oblique plane 23 at the other side exposed at the rear of the main body 10 (shown in FIG. 2); when the stapler is under normal operation state, the upper cover 11, main body 10 and base 12 are connected (shown in FIG. 1); referring to FIG. 3, the spring 22 at rear of the locating block 20 is under compression state, so that the locating block 20 is located within the groove 14 between the reinforced ribs 13 of the upper cover 11, enabling the upper cover 11 to press down normally for stapling operation; referring to FIG. 2, when the base 12 of the stapler is opened, the oblique plane 23 at the other side of the locating block 20 cannot be pressed; in such case, the spring 22 will be expanded to push the locating block 20 underneath the reinforced rib 13 within the upper cover 11 as shown in FIG. 4; in such case, the upper cover 11 cannot press down due to the blocking of the locating block 20, thus disabling the action of the stapler's linkage mechanism; referring to FIG. 2, if you intend to resume it to the serviceable condition, the base 12 and the main body 10 are restored into a closed state (shown in FIG. 1), the lateral plate of the base 12 will drive the oblique plane 23 of the locating block 20 to be pushed back easily into the main body 10; referring to FIG. 3, the locating block 20 is located within the groove 14 between the reinforced ribs 13 of the upper cover 11, so the stapler is resumed to a serviceable state.

With the configuration of the locating block 20, when the stapler of the present invention is under an idle state, especially if the users or even children open the base 12 and hold manually the upper cover 11 and main body 10, the upper cover 11 will be disabled due to the limitation of the locating block 20, thus eliminating the possibility of unexpected safety hazards due to ejection of staples.

Figure 6:
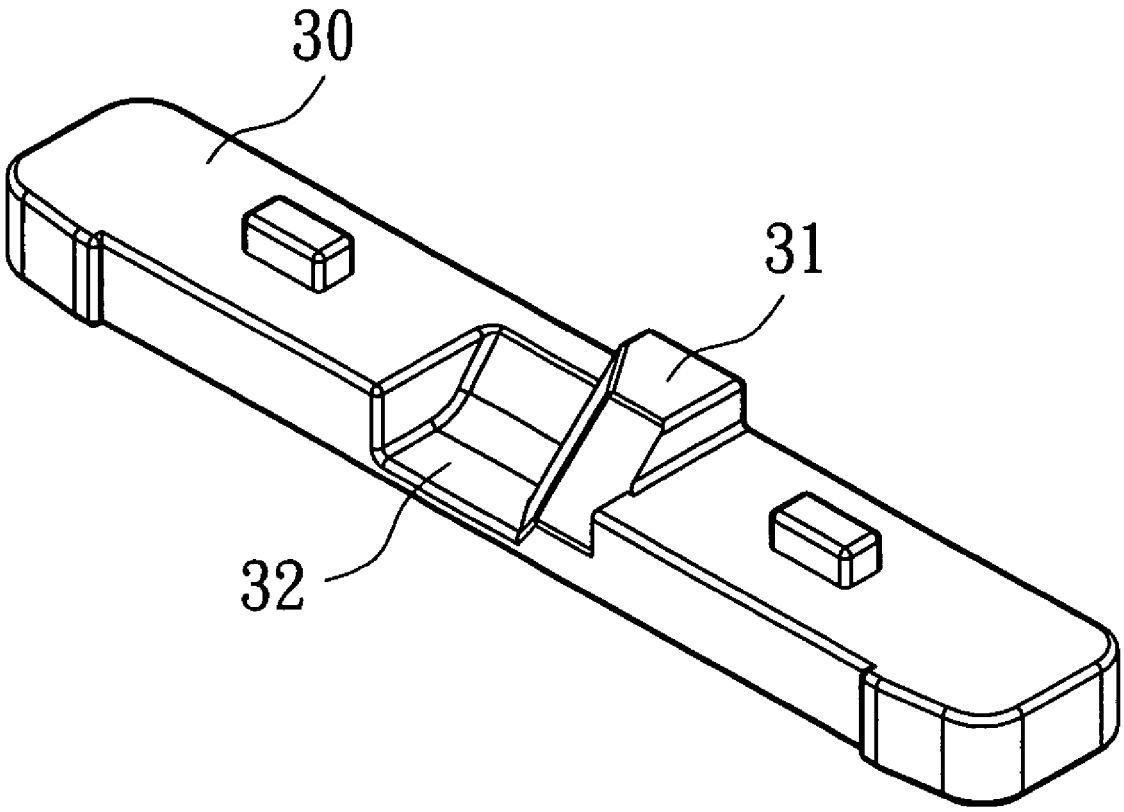
FIG. 6 shows a view of the present invention that a push rod is installed at front of the main body.
Figure 7:
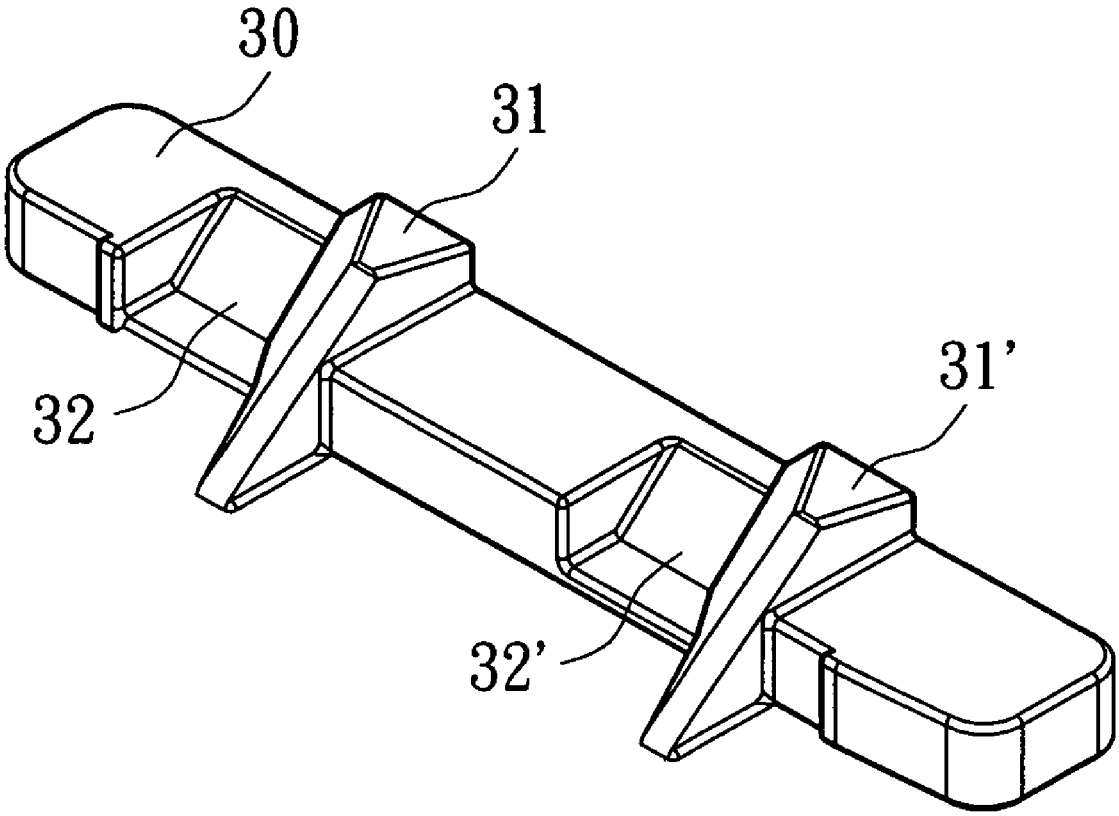
FIG. 7 shows another view of the present invention that a push rod is installed at front of the main body.
Figure 8:
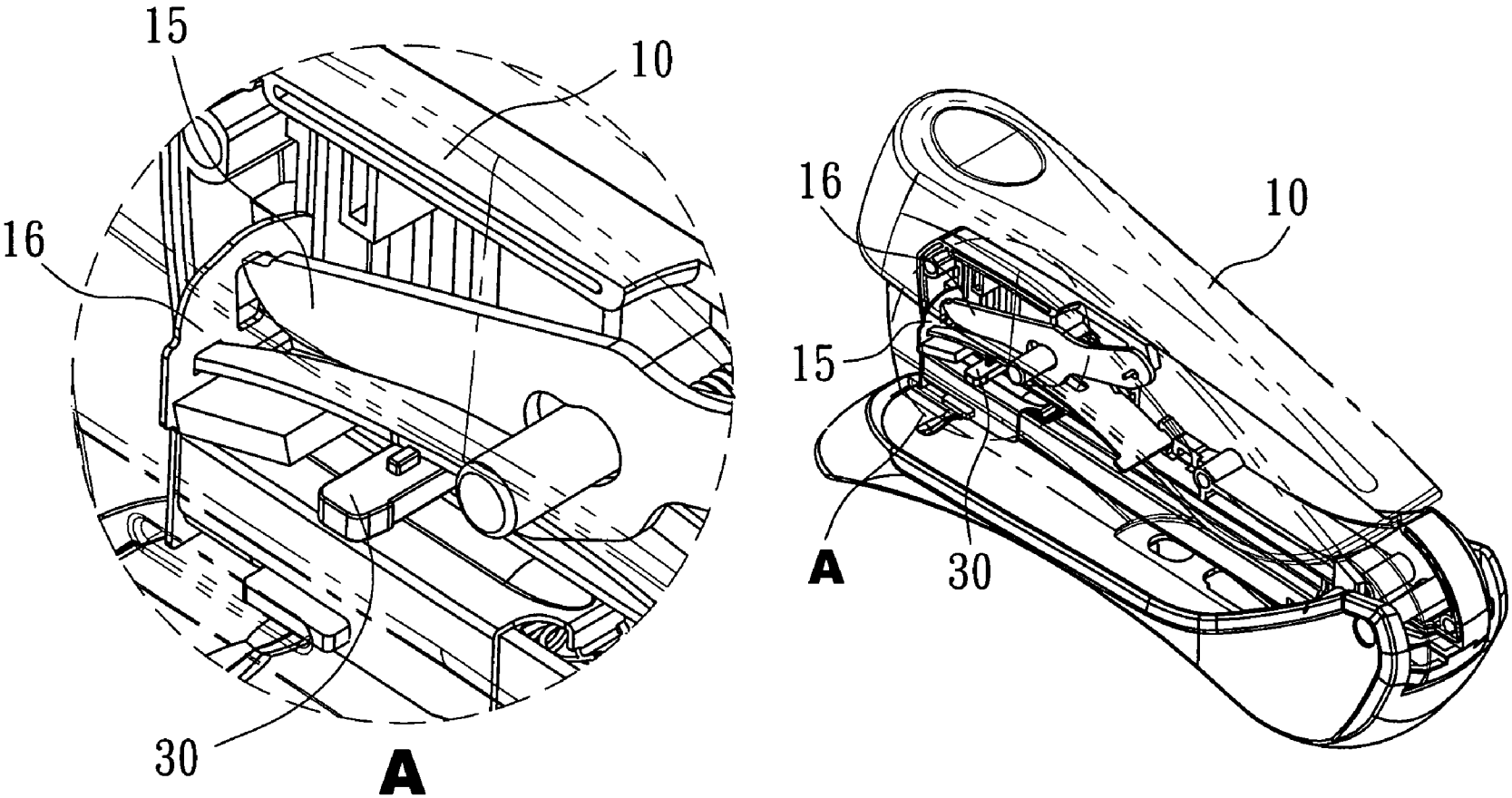
FIG. 8 shows a perspective view of the present invention that the push rod, deflector rod and striking slice are in coupling state.
Figure 9:
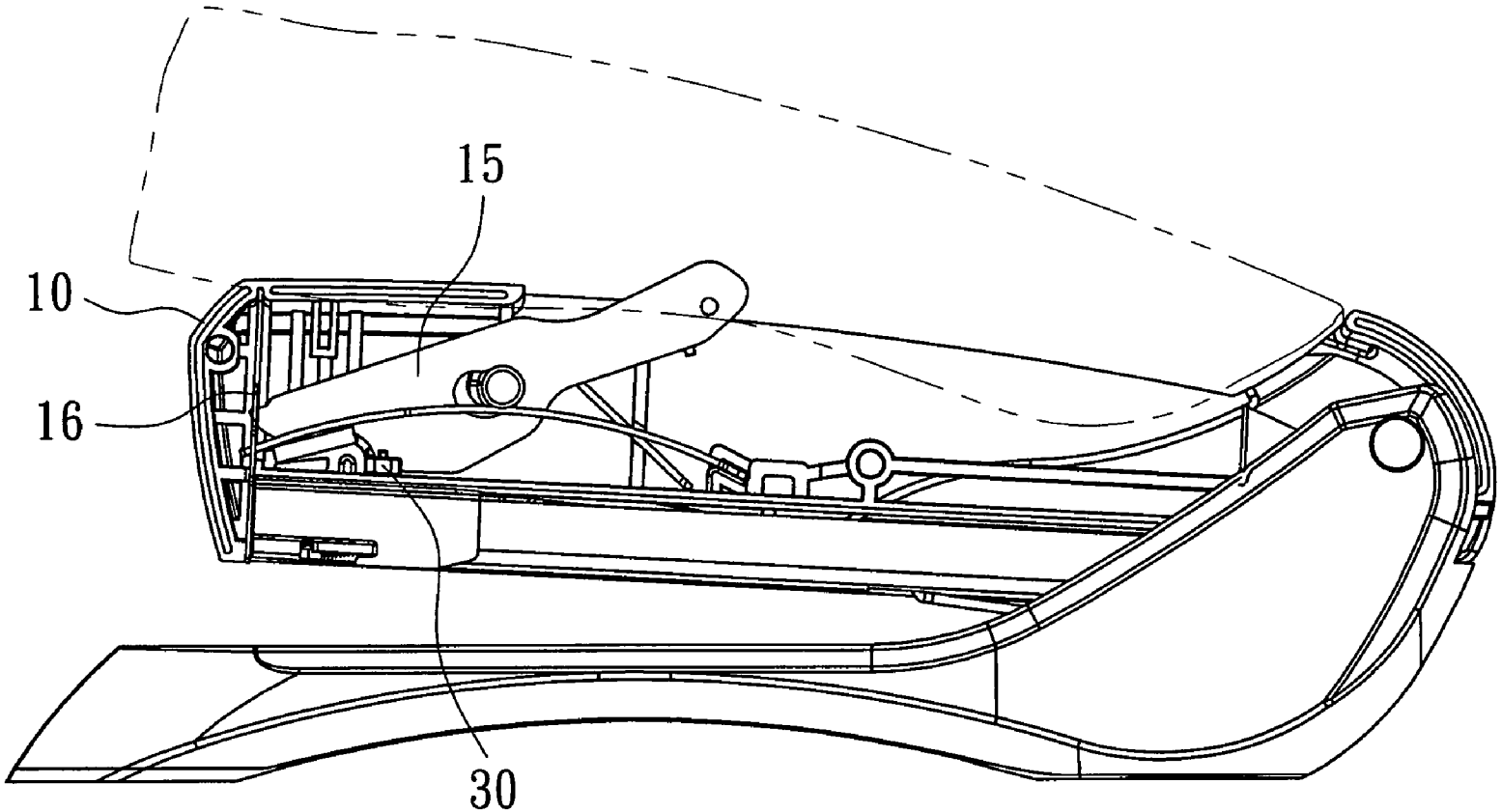
FIG. 9 shows a plane view of the present invention that the push rod, deflector rod and striking slice are in coupling state.
Figure 10:
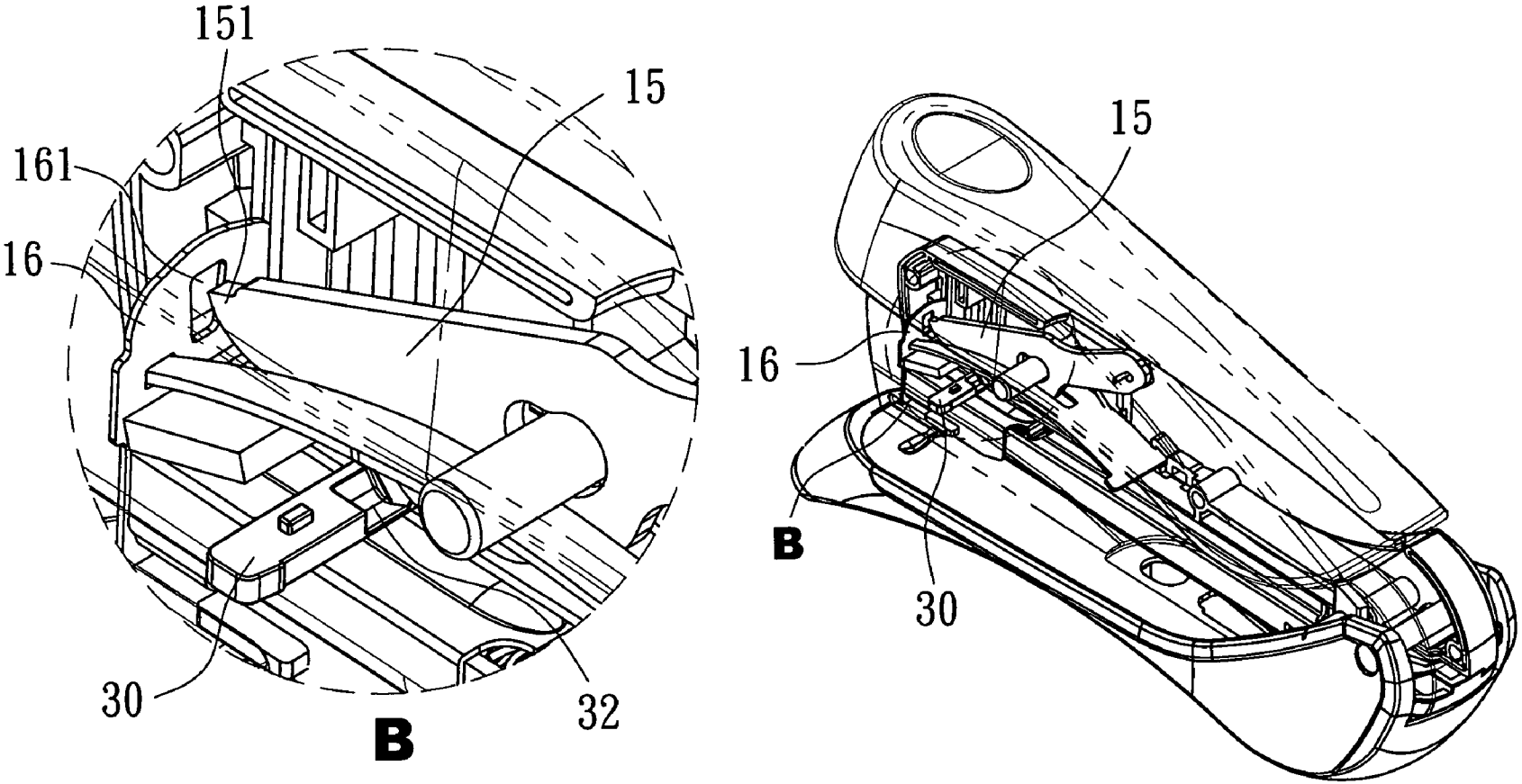
FIG. 10 shows a perspective view of the present invention that the push rod, deflector rod and striking slice aren't in coupling state.
Figure 11:
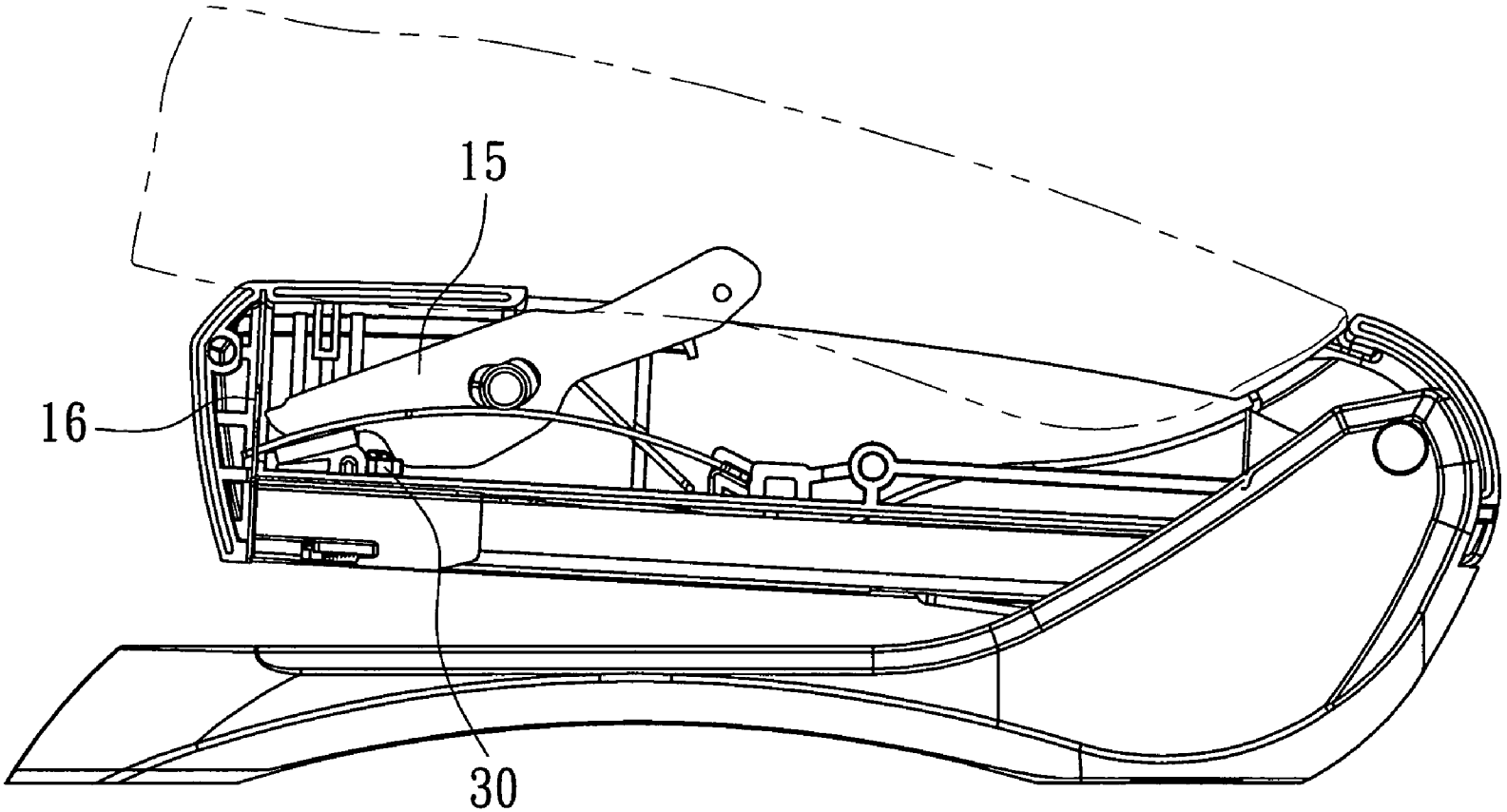
FIG. 11 shows a plane view of the present invention that the push rod, deflector rod and striking slice aren't in coupling state.

Referring to FIGS. 1, 6, 7, 8, 9, 10, 11, to enhance the protection function of the present invention, a push rod 30 crossing the main body 10 is arranged at left and right front sides of the main body 10 (shown in FIG. 1); referring to FIGS. 6, 7, at least a bulge 31, 31' and adjacent grooves 32, 32' are formed on the push rod 30; when the push rod 30 is located, the relative positions are shown in FIGS. 8, 9, or 10, 11; referring to FIGS. 8, 9, the main body 30 of the stapler comprises: a deflector rod 15 and striking slice 16 at a normal position for continuously striking the staples; in such case, the groove 32 of the push rod 30 is located under the deflector rod 15 without affecting its driving of the striking slice 16; when the push rod 30 is slightly squeezed out of the main body 10 from the other side, the bulges 31, 31' adjacent to the groove 32 could jack up the deflector rod 15 and make it shift backwards slightly; referring to FIGS. 10, 11, the deflector rod end 151 is disengaged from the snapping hole 161 of the striking slice, namely, the deflector rod end 151 isn't hooked to the snapping hole 161; thus, even if the upper cover 11 of the stapler presses down and the deflector rod 15 moves accordingly, the end cannot drive the striking slice 16, disabling the continuous striking action.

In other words, with the left and right shift of the push rod 30, the deflector rod 15 and striking slice 16 within the main body 10 could be either coupled or disengaged, thus forming another protective device for manually-controlled powerful stapler.

Based on the design of the present invention that an active protective device is composed of locating block 20 and spring 22, and a manual push rod 30 is placed at front of the main body 10, this stapler can be operated safely without potential safety hazards due to misunderstanding and misoperation of the users.

What is claim is:

1. A dual protective device of heavy-duty stapler, which is composed of upper cover, main body and base; an active protective device is arranged between the rear of the main body and the upper cover, comprising:

a L-shaped locating block, with a sleeving hole at one side, and a reduced oblique plane at the other side and protruding from the main body;

a spring, arranged between the sleeving hole of locating block and lateral plate of the main body;

the locating block is located within a groove between a reinforced rib of the upper cover at rear side of the main body; with the extension or compression of the spring, the locating block is driven to shift underneath the upper cover's reinforced rib or groove.

2. The device defined in claim 1, wherein the oblique plane at one side of said locating block is protruded between the main body and a retracted internal plate of the base.

3. The device defined in claim 1, wherein the oblique plane at one side of said locating block is protruded out of the main body when the base is opened.

4. The device defined in claim 1, wherein the oblique plane at one side of said locating block is protruded out of the main body when the base is opened.

* * * * *